US006766781B2

(12) United States Patent
Penzel et al.

(10) Patent No.: US 6,766,781 B2
(45) Date of Patent: Jul. 27, 2004

(54) CRANKCASE FOR AN INTERNAL COMBUSTION ENGINE, ESPECIALLY FOR A BOXER ENGINE

(75) Inventors: Matthias Penzel, Leonberg (DE); Christian Schwarzl, Wettstetten (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 55 days.

(21) Appl. No.: 10/088,360

(22) PCT Filed: Jun. 28, 2001

(86) PCT No.: PCT/EP01/07380

§ 371 (c)(1),
(2), (4) Date: Jul. 19, 2002

(87) PCT Pub. No.: WO02/16747

PCT Pub. Date: Feb. 28, 2002

(65) Prior Publication Data

US 2003/0089321 A1 May 15, 2003

(51) Int. Cl.[7] ..... F02F 7/00

(52) U.S. Cl. ..... 123/195 HC; 123/55.5; 123/55.7

(58) Field of Search ..... 123/195 HC, 53.6–55.7

(56) References Cited

U.S. PATENT DOCUMENTS 5,487,363 A * 1/1996 Batzill et al. ..... 123/41.74
6,276,324 B1 * 8/2001 Adams et al. ..... 123/90.27
6,279,522 B1 * 8/2001 Balzar et al. ..... 123/90.1
6,439,215 B1 * 8/2002 Sato et al. ..... 123/572
6,644,290 B2 * 11/2003 Yoneyama et al. ..... 123/572

FOREIGN PATENT DOCUMENTS

| | | |
|---|---|---|
| DE | 40 01 514 | 8/1990 |
| DE | 44 33 801 | 11/1995 |
| DE | 198 45 183 | 4/2000 |
| DE | 100 40 476 | 8/2001 |
| GB | 323733 | 12/1929 |
| JP | 60027765 | 2/1985 |

* cited by examiner

*Primary Examiner*—Marguerite McMahon
(74) *Attorney, Agent, or Firm*—Crowell & Moring LLP

(57) ABSTRACT

The invention relates to a crankcase for an internal-combustion engine, particularly for a horizontally opposed engine, having two crankcase halves (10, 12) in which bearing sections (18) with bearing bores (24) for the crank pins of a crankshaft are arranged, the two crankcase halves (10, 12) being screwed to one another in the area of the bearing bores (24), as well as having cylinder bores (14, 16) for receiving the pistons.

It is suggested that the plane of division (30) of the two crankcase halves (10, 12) extend at an angle α, and that the longitudinal axis (36) of the bearing bolts (26, 28) extend essentially at a right angle with respect to the plane of division (30).

This results in a screwing-together of the two crankcase halves (10, 12) which is free of transverse force and is arranged close to the bearing bore (24).

19 Claims, 4 Drawing Sheets

CRANKCASE FOR AN INTERNAL COMBUSTION ENGINE, ESPECIALLY FOR A BOXER ENGINE

The invention relates to a crankcase for an internal-combustion engine, particularly for a horizontally opposed engine, according to claim 1.

From German Patent Document DE 40 01 514 A1, a two-part crankcase for a horizontally opposed engine is known, whose two halves are screwed to one another in the area of the bearing blocks for the crankshaft which are integrated in the crankcase. Since the bearing blocks with the bearing bores for receiving the crankshaft extend at the level of the cylinder bores, the bores for receiving the bearing bolts must be placed at a corresponding distance from the circumference of the cylinder bore, as illustrated in the drawing of German Patent Document DE 40 01 514 A1. This results in a corresponding distance between the bearing bore for the crankshaft and the bores for fastening the two crankcase halves, which distance, under certain circumstances may result in an undesirable gaping of the bearing blocks during the operation of the internal-combustion engine.

It is therefore an object of the invention to implement the screwed connection of the two crankcase halves such that the bearing bolts can extend close to the bearing bore for receiving the crank pins.

According to the invention, this object is achieved by means of the characteristics of claim 1.

As a result of the fact that the screwing-together of the two crankcase halves takes place diagonally, that is, at an angle with respect to the center axis of the cylinder bore, the bores for the screwed connection of the bearing blocks may extend closer to be bearing bore. So that the transverse forces occurring in the case of a diagonal screwing-together are eliminated, the plane of division of the two crankcase halves extends essentially at the same angle at which the longitudinal axis of the bearing bolts is aligned with respect to the center axis of the cylinder bores. In other words, the longitudinal axis of the bearing bolts extends essentially at a right angle with respect to the plane of division of the two crankcase halves, so that advantageously no transverse forces occur in the case of the screwed connection according to the invention.

Additional advantages and advantageous further developments of the invention are contained in the subclaims and in the description.

An embodiment of the invention will be explained in the following description and drawing.

DESCRIPTION OF THE EMBODIMENT

Figure 1:
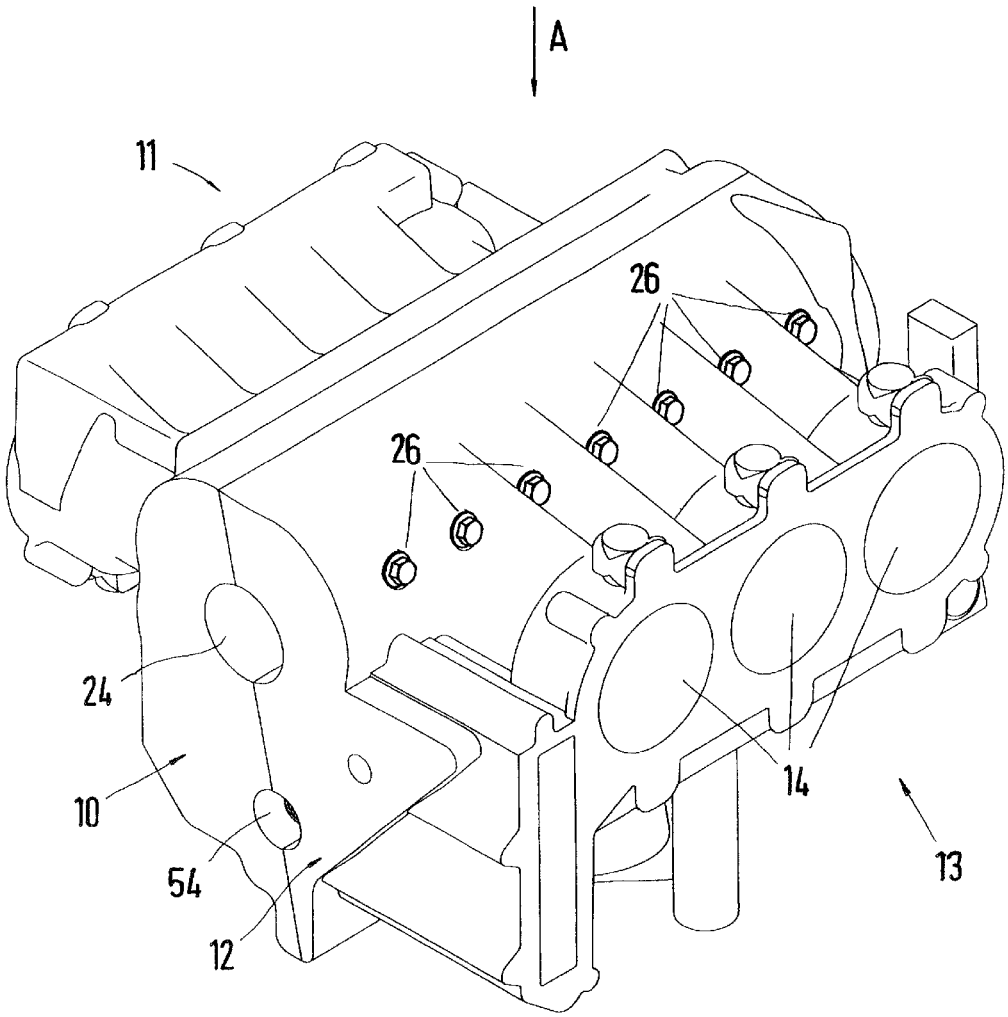
FIG. 1 is a schematic overall view of the crankcase of an internal-combustion engine.
Figure 2:
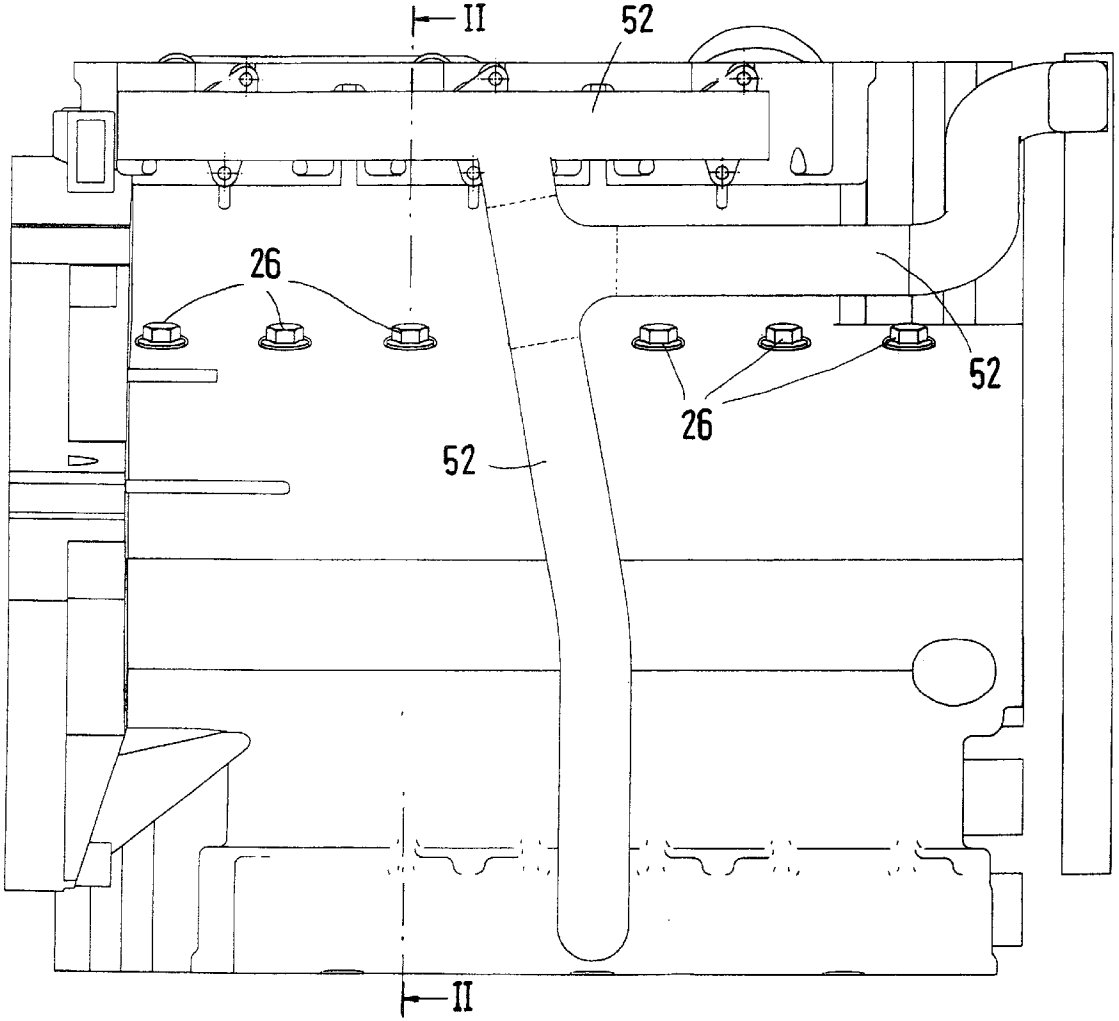
FIG. 2 is a top view of the crankcase in the direction of the arrow A in FIG. 1.
Figure 3:
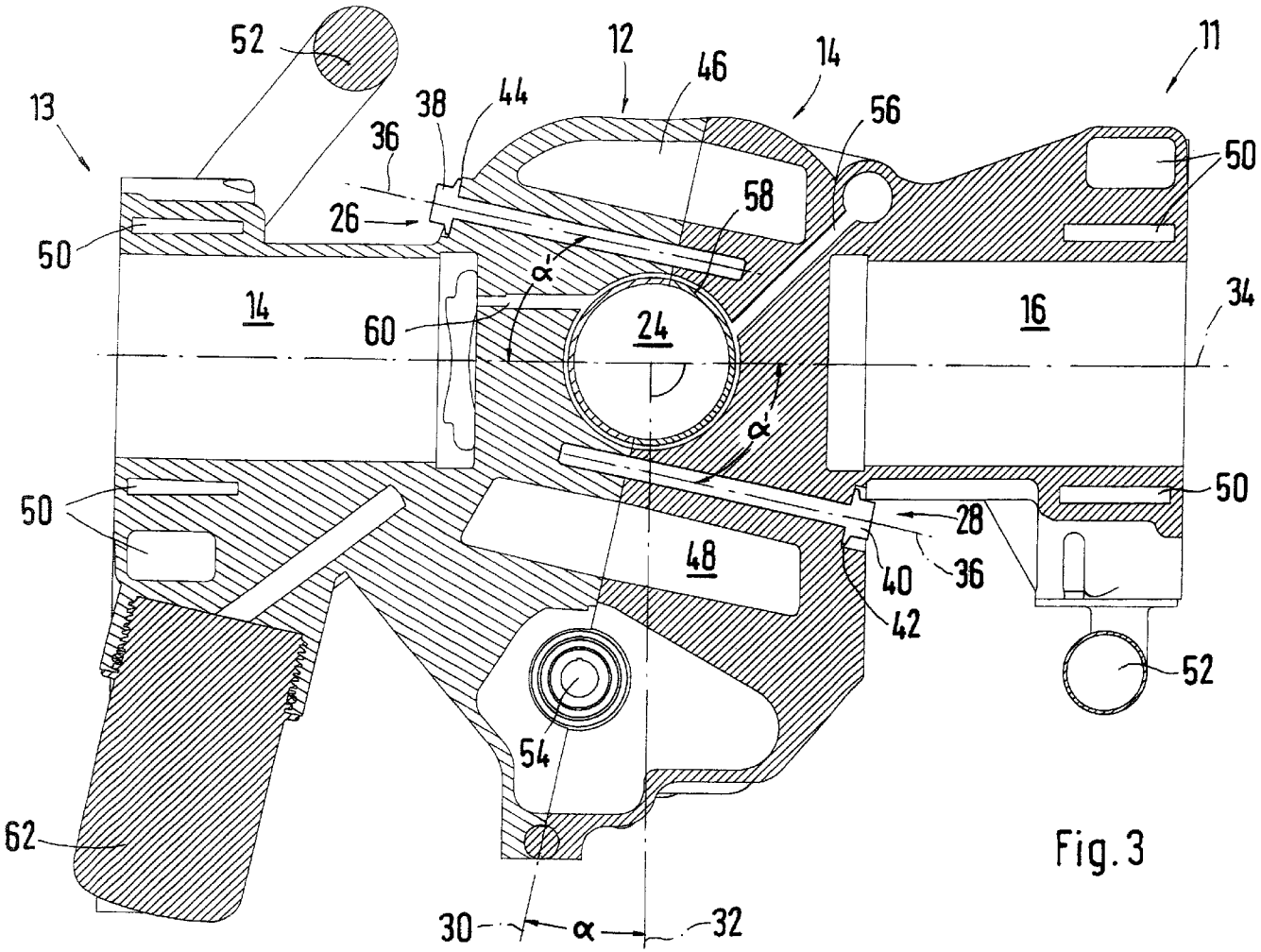
FIG. 3 is a sectional view along Line II—II in FIG. 2.
Figure 4:
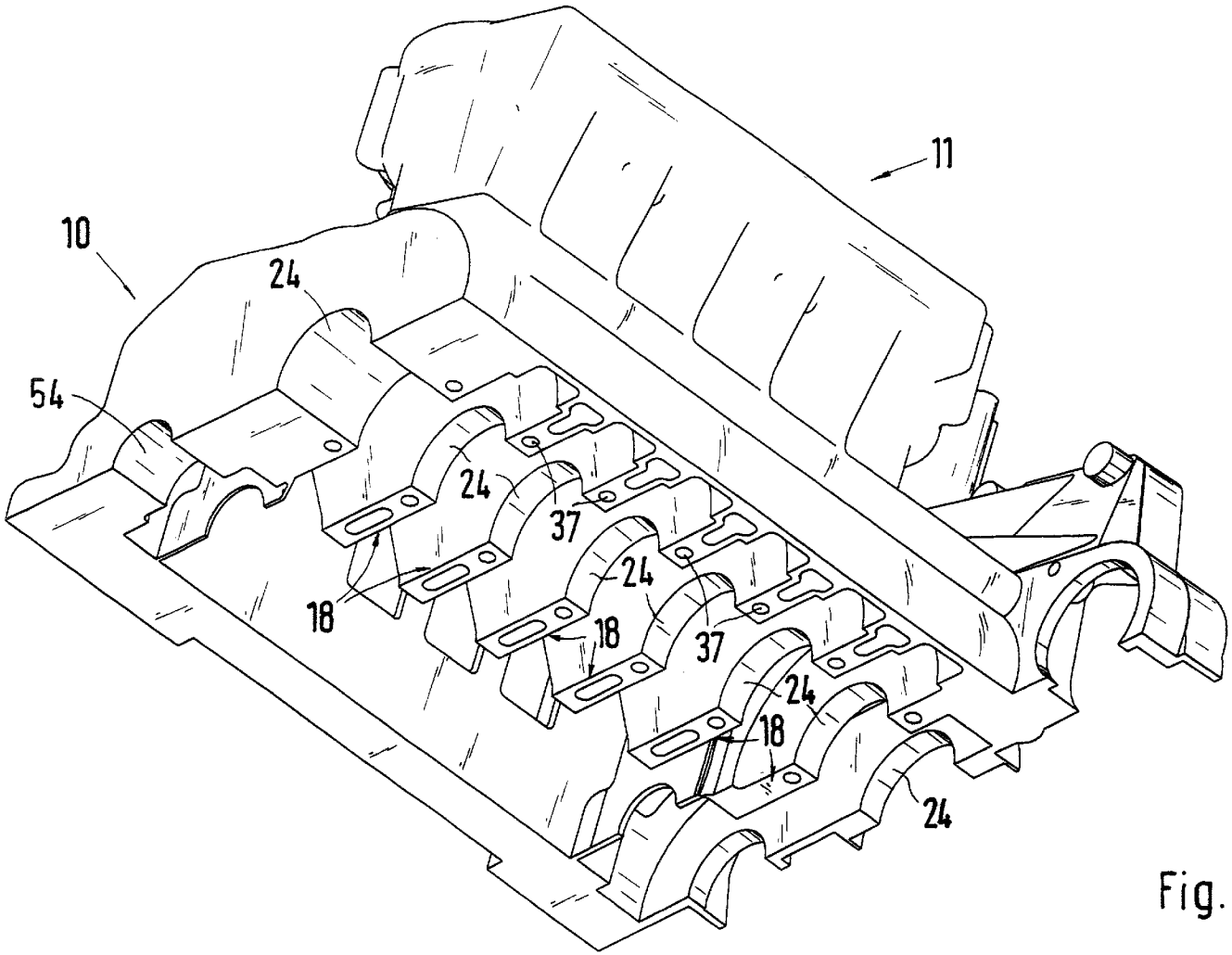
FIG. 4 is a perspective view of a crankcase half.

The crankcase illustrated in the drawing for a 6-cylinder horizontally opposed engine, without being limited to this embodiment, comprises two crankcase halves 10 and 12 with two cylinder banks 11 and 13 in which the cylinder bores 14 and 16 are arranged. Each of the two crankcase halves 10 and 12 has several bearing sections arranged behind one another and in the following called bearing blocks,in which one half respectively of a bearing bore 24 is constructed for a crankshaft which is not shown. In the assembled condition, the bearing bores 24 each accommodate a crank pin of the crankshaft. The screwing-together of the bearing blocks 18 takes place by way of two bearing bolts 26, 28 respectively, by means of which the two crankcase halves 10 and 12 are simultaneously screwed together. As illustrated in FIG. 3, the plane of division 30 of the two crankcase halves 10 and 12, relative to a line 32 extending essentially perpendicular to the longitudinal cylinder axis 34, extends at an angle $\alpha$ which, in the present case, amounts to approximately 12°. The longitudinal axes 36 of the bearing bolts 26, 28, in turn, relative to the longitudinal cylinder axis 34, extend at an angle $\alpha'$ which essentially corresponds to the angle $\alpha$ of the diagonally extending plane of division of the two crankcase halves 10 and 12.

As a result of the fact that the bearing bolts 26, 28 are arranged diagonally relative to the longitudinal cylinder axis 34, the bores 37 for screwing together the bearing blocks may extend closer to the bearing bores 24. As a result, the gas forces and forces of gravity exercised upon the crankshaft during the combustion can be reliably absorbed and a gaping of the bearing blocks 18, particularly in the area adjoining the bearing bore 24, is prevented. As a result of the fact that the longitudinal axes 36 of the bearing bolts 26, 28 extend at a right angle with respect to the plane of division 30 of the two crankcase halves 10, and 12, no transverse forces occur during the screwing-together, which otherwise would have to be absorbed by additional form-locking connections. The bolt heads 38 and 40 of the mutually opposite bearing bolts 26 and 28, which are arranged parallel to one another, are supported on an exterior screw surface 42 and 44 of the crankcase halves 10 and 12, the screwing surfaces 42, 44 being arranged approximately at the level of the lower end of the cylinder bores 14, 16. The bearing bolts 26, whose bolt heads 38 are supported on the screwing surface 44 of the crankcase half 12, are screwed in the other crankcase half 14 in a blind hole bore provided with a thread. Analogously, the bearing bolts 28, whose screw heads 40 are supported in the exterior screwing surface 42 of the crankcase half 14, are screwed in the opposite crankcase half 12 in a blind hole bore provided with a thread. In the present embodiment, seven bearing blocks 18 are provided for the 6-cylinder horizontally opposed engine.

Additional components illustrated in the drawing represent the following: The recesses 46, 48 are part of the crank space. The openings 50 are water-carrying ducts which are supplied with cooling water by way of corresponding connections 52. The opening 54 arranged below the bearing bore 24 with respect to the installed position of the horizontally opposed engine is used for receiving an intermediate shaft, which is not shown, for driving the camshafts arranged in the cylinder head. A duct 56, which leads to a bearing block 18, is used for supplying lubricating oil to the crankshaft, in which case bearing bushes 58 also known from the prior art are arranged in the individual bearing blocks 18. A duct 60 originating from the bearing bore 24 and leading to the cylinder bore 14 is used for a splash oil cooling, which is not shown in detail, for the pistons. As generally customary, an oil filter 62 is screwed to the crankcase and is used for cleaning the lubricating oil.

What is claimed is:

1. Crankcase for a horizontally opposed piston internal-combustion engine, having two crankcase halves in which bearing sections with bearing bores for crank pins of a crankshaft are arranged, the two crankcase halves being screwed to one another in an area of the bearing bores, as well as having cylinder bores for receiving the pistons, wherein a plane of division of the two crankcase halves extends at an angle $\alpha$ with respect to a vertical plane, and wherein the longitudinal axes of the bearing bolts extend essentially at a right angle with respect to the plane of division.

2. Crankcase according to claim 1, wherein the bearing bolts are supported on an exterior screwing surface of the crankcase and are therefore accessible from the outside.

3. Crankcase according to claim 1, wherein the cylinder banks integrated in the two crankcase halves are arranged at an angle of 180° with respect to one another, wherein the screwing-together of the crankcase halves takes place at a level of a lower end of the cylinder bores.

4. Crankcase according to claim 2, wherein the cylinder banks integrated in the two crankcase halves are arranged at an angle of 180° with respect to one another, wherein the screwing-together of the crankcase halves takes place at a level of a lower end of the cylinder bores.

5. Crankcase according to claim 1, wherein said angle $\alpha$ is an acute angle.

6. Crankcase according to claim 5, wherein said angle $\alpha$ is between 10° and 15°.

7. Crankcase according to claim 6, wherein said angle $\alpha$ is 12°.

8. A crankcase assembly for an internal combustion engine with horizontally opposed pistons comprising:

a first crankcase half made in one piece and exhibiting a plurality of bearing sections forming bearing bore part sections, said first crankcase half including a plurality of cylinder bores, a second crankcase half made in one piece and exhibiting a plurality of bearing sections forming bearing bore part sections, said second crankcase half including a plurality of cylinder bores, bearing bolt bores in the respective first and second crankcase halves, and bearing bolts extending in said bearing bolt bores and operable to fixedly connect the crankcase halves together with their respective bearing bore part sections together forming bearing bores for crankpins of an engine crankshaft, wherein said bearing halves have respective mating surfaces which extend along a dividing plane which is inclined at an acute angle with respect to a vertical plane extending perpendicular to a plane of said cylinder bores, and wherein said bearing bolt bores extend perpendicular to said dividing plane.

9. Crankcase assembly according to claim 8, wherein the bearing bolts are supported on an exterior screwing surface of the crankcase and are therefore accessible from the outside.

10. Crankcase assembly according to claim 9, wherein the cylinder banks integrated in the two crankcase halves are arranged at an angle of 180° with respect to one another and wherein the screwing-together of the crankcase halves takes place at a level of a lower end of the cylinder bores.

11. Crankcase assembly according to claim 8, wherein said acute angle is between 10° and 15°.

12. Crankcase assembly according to claim 11, wherein said acute angle is 12°.

13. Crankcase assembly according to claim 10, wherein the bearing bolts are supported on an exterior screwing surface of the crankcase and are therefore accessible from the outside.

14. A method of making a crankcase assembly for an internal combustion engine with horizontally opposed pistons comprising:

forming a first crankcase half in one piece which exhibits a plurality of bearing sections forming crackpin bearing bore part sections, said first crankcase half including a plurality of cylinder bores, forming a second crankcase half in one piece which exhibits a plurality of bearing sections forming crackpin bearing bore part sections, said second crankcase half including a plurality of cylinder bores, providing bearing bolt bores in the respective first and second crankcase halves, and fixing the crankcase halves together with bearing bolts extending in said bearing bolt bores and with their respective bearing bore part sections together forming crankpin bearing bores for crankpins of an engine crankshaft, wherein said bearing halves have respective mating surfaces which extend along a dividing plane which is inclined at an acute angle with respect to a vertical plane extending perpendicular to a plane of said cylinder bores, and wherein said bearing bolt bores extend perpendicular to said dividing plane.

15. A method of making a crankcase assembly according to claim 14, wherein the bearing bolts are supported on an exterior screwing surface of the crankcase and are therefore accessible from the outside.

16. A method of making a crankcase assembly according to claim 14, wherein the cylinder banks integrated in the two crankcase halves are arranged at an angle of 180° with respect to one another and wherein the screwing-together of the crankcase halves takes place at a level of a lower end of the cylinder bores.

17. A method of making a crankcase assembly according to claim 14, wherein said acute angle is between 10° and 15°.

18. A method of making a crankcase assembly according to claim 17, wherein said acute angle is 12°.

19. A method of making a crankcase assembly according to claim 16, wherein said acute angle is between 10° and 15°.

* * * * *